US005520011A

United States Patent [19]

Hibino

[11] Patent Number: 5,520,011

[45] Date of Patent: May 28, 1996

[54] ICE MAKING UNIT STRUCTURE OF FLOW TYPE ICE MAKING MACHINE

[75] Inventor: Takashi Hibino, Toyoake, Japan

[73] Assignee: Hoshizaki Denki Kabushiki Kaisha, Aichi-Ken, Japan

[21] Appl. No.: 408,383

[22] Filed: Mar. 22, 1995

[30] Foreign Application Priority Data

Mar. 23, 1994 [JP] Japan ..... 6-052182

[51] Int. Cl.[6] ..... F25C 1/12

[52] U.S. Cl. ..... 62/347; 239/556

[58] Field of Search ..... 62/347; 239/556, 239/557, 566, 567; 248/201

[56] References Cited

U.S. PATENT DOCUMENTS 3,333,773 8/1967 Hutchinson ..... 239/567 X 4,601,176 7/1986 Suyama ..... 62/347 X 4,862,706 9/1989 Yoshida et al. ..... 62/347

*Primary Examiner*—William E. Tapolcai

*Attorney, Agent, or Firm*—Wenderoth, Lind & Ponack

[57] ABSTRACT

A flow type ice making machine comprises at least one cooling zigzag pipe 14 or 15 through which a coolant flows, a pair of ice making plates 17 and 18 vertically disposed so as to sandwich the cooling zigzag pipe therebetween, and a pair of mount plates 11 and 12 vertically disposed at both ends of the ice making plates, respectively, and supporting opposite bent ends of the cooling zigzag pipe. The pair of mount plates have respective cut-out portions **11*b* and 12*b* being open upward, and a sprinkling device is inserted to the cut-out portions so as to cover upper ends of the ice making plates. A pair of extension fins 27*a* and 27*b*** formed along opposite outer side surfaces of the sprinkling device, respectively, are sandwiched between the pair of mount plates to thereby position and fix the sprinkling device.

10 Claims, 9 Drawing Sheets

ICE MAKING UNIT STRUCTURE OF FLOW TYPE ICE MAKING MACHINE

BACKGROUND OF THE INVENTION

1. Field of the Invention

The present invention relates to a flow type ice making machine in which ice making water is frozen while the ice making water is flowing down over surfaces of a pair of ice making plates vertically disposed in back-to-back relation, and more particularly to an ice making unit structure of the ice making machine.

2. Description of the Related Art

In such a flow type ice making machine as one kind of automatic ice making machines, ice is made by supplying ice making water so as to flow down over surfaces of ice making plates which are cooled by utilizing the heat of evaporation of a coolant. A cooling zigzag pipe through which the coolant flows is disposed in contact with a back surface of the ice making plate. Generally, the cooling zigzag pipe is sandwiched between a pair of ice making plates vertically disposed in back-to-back relation (see, e.g., Japanese Utility Model Laid-Open No. 62-176669, Japanese Utility Model Publication Nos. 61-39262 and 1-24538, and Japanese Patent Publication No. 62-18820).

In the above-described structure, since the ice making plates are each formed of a thin metal material, the rigidity and the strength of the entire structure is given by a pair of mount plates for holding opposite bent ends of the cooling zigzag pipe and a body frame coupling the pair of mount plates to each other. Above the ice making plates, an ice making water sprinkler and an ice removing water sprinkler are disposed to extend in the direction of length of the machine between the pair of mount plates along the ice making plates. The ice making water sprinkler sprinkles ice making water over surfaces of the ice making plates facing outward in an ice making cycle, and the sprinkled ice making water flows down while contacting those surfaces of the ice making plates, i.e., ice making surfaces. On the other hand, the ice removing water sprinkler sprinkles ice removing water between the back surfaces of the pair of ice making plates in an ice removing cycle.

Positioning of the above sprinkler in the longitudinal direction (usually in the horizontal direction) may be effected by fitting the mount plates to grooves formed in respective side surfaces of the sprinkler's end portions, but this method requires a relatively long time for assembly work. Therefore, a structure for assembling the sprinkler by one-touch operation is previously proposed by the applicant and filed as Japanese Utility Model Application No. 5-34991.

The structure proposed will now be briefly described with reference to FIG. 7. Two pairs of ice making plates 2*a*, 2*b* are disposed side by side between a pair of mount brackets 1*a*, 1*b*, each pair of ice making plates 2*a*, 2*b* being arranged in back-to-back relation. Cooling zigzag pipes 3*a*, 3*b* extending between the two pairs of ice making plates 2*a*, 2*b*, respectively, are fixed to and supported by the mount brackets 1*a*, 1*b*. An ice removing water sprinkler 4 and an ice making water sprinkler 7 are combined and inserted to rectangular holes formed in upper portions of the mount brackets 1*a*, 1*b*. The ice removing water sprinkler 4 comprises two horizontal thin sprinkling tubes 5 extending parallel and integrally coupled to each other by a connecting portion 6, whereas the ice making water sprinkler 7 comprises two horizontal wide sprinkling tubes 8 extending parallel and integrally coupled to each other by a connecting portion 9. Further, positioning stoppers 8*a*, 8*b* are projected from respective outer side surfaces of the horizontal wide sprinkling tubes 8.

FIG. 8 is a plan view showing the ice making water sprinkler 7 in its fixed state. The stoppers 8*a*, 8*b* have grooves or slots formed therein to receive corresponding edges of the mount bracket 1*a* as shown. Specifically, the stoppers are designed such that when the sprinkler 7 is pushed in the direction of arrow A and reaches the illustrated position, the slots and the mount brackets 1*a* are engaged with each other as shown, thereby positioning and fixing the sprinkler 7.

In the above-described conventional structure wherein the sprinkler is positioned and fixed by fitting the mount plates to the grooves formed in the outer side surfaces of the sprinkler, if the grooves are not machined with good dimensional accuracy, it would be difficult to fit the mount plates to the grooves or, conversely, the sprinkler would wobble because of plays occurred therebetween.

Also, in the previously proposed structure wherein the sprinkler 7 is inserted to the rectangular holes in the mount plates or brackets and the grooves (slots) formed in the stoppers are engaged with the mount brackets, there arise problems below. It is general that, in the snap-fitting structure as shown in FIG. 8, the sprinkler 7 is formed of plastic to utilize elastic deformation of the stoppers 8*a*, 8*b* for snap-fitting. Accordingly, if a large error is caused in spacings between the stoppers 8*a*, 8*b* and between the rectangular holes, a serious problem would be resulted. For example, when the spacing M between the stopper slots is larger than the design size which corresponds to the spacing L between the rectangular holes, a tip end of the stopper 8*b* is shaven and turned up as shown in FIG. 9. Conversely, when the spacing M between the stopper slots is smaller than the design size, the stoppers 8*a*, 8*b* lose completely their functions of locking the sprinkler in place, or are so loose that the sprinkler is easily slipped off in the direction of arrow B in FIG. 8. One reason is that the plastic-made stopper 8*a*, 8*b* are relatively soft with respect to the metal-made mount plate 1*a*. Anyway, to solve the above drawbacks, manufacture accuracy of the relevant members must be remarkably improved, and a production cost is inevitably increased.

As an alternative means to solve the drawbacks mentioned above with reference to FIGS. 8 and 9, it would be conceivable, as shown in FIG. 10, to provide stoppers 8A, 8B which are extended in the opposite direction to the stoppers 8*a*, 8*b* shown in FIG. 9. In this case, too, the ice making unit cannot have an structure capable of accurately positioning the sprinkler with easy assembly, unless manufacture accuracy is improved.

More specifically, the ice making water sprinkler 7 is required to be positioned in the longitudinal direction such that sprinkling holes formed in a bottom wall of the sprinkling tube 8 are surely situated in predetermined positions with respect to the surfaces (ice making surfaces) of the ice making plates 2*a* and 2*b*. If the sprinkling holes of the sprinkling tube 8 are deviated from the predetermined positions with respect to the ice making plates 2*a* and 2*b*, the flows of the ice making water over the ice making surfaces would be changed to produce ice having an indefinite or deformed shape. Hence the quality of ice would be deteriorated and, in some cases, the ice machine would fail to remove the produced ice.

Likewise, the ice removing water sprinkler 4 must also be positioned such that sprinkling holes of the sprinkler 4 are situated in predetermined positions with respect to rear surfaces of the ice making plates 2a and 2b. If the positions of the sprinkling holes are deviated with respect to the ice-making plates 2a and 2b, the flows of the ice removing water would be changed, reducing the ice removing ability.

Further, if the ice making water sprinkler 7 and the ice removing water sprinkler 4 are overly projected in the direction of arrow B in FIG. 8, the water flow would overflow out of the ice making region, giving rise to a serious trouble.

Further, during the use for a long term, the interior of the sprinkler becomes dirty with deposition of the fur and impurities such as calcium and silicon contained in water. Though not shown in FIG. 8, it is therefore desirable to form a hole in, e.g., a distal end face of the sprinkling tube and to fit a cleaning plug to the hole, the plug being removed when the interior of the sprinkler is cleaned. The cleaning plug is a cone-shaped plug made of elastic material such as rubber, and is held in place by an elastic force developed at the time it is press-fitted to the hole formed in the sprinkling tube. However, when the ice machine is used for a long term, a reduction in the elastic force is inevitable and hence the cleaning plug may be so loosened as to cause leakage of water. On that occasion, if the sprinkler is loosely locked by the stoppers, there is a risk that the sprinkler may be pushed out in the direction of arrow B in FIG. 8 by water pressure. Finally, the cleaning plug is slipped off and water is scattered in all directions through the hole from which the cleaning plug has come out. This results in troubles that ice can no longer be manufactured and water is leaked.

SUMMARY OF THE INVENTION

An object of the present invention is to provide an ice making unit structure of a flow type ice making machine in which sprinklers and associated parts can be manufactured with ordinary manufacture accuracy at a low cost and easily assembled, the sprinklers can be surely positioned and fixed, and a cleaning plug can be surely held in place.

To achieve the above object, an ice making unit structure of a flow type ice making machine according to the present invention comprises: a cooling zigzag pipe through which a coolant flows, at least one pair of ice making plates vertically disposed so as to sandwich the cooling zigzag pipe therebetween, a pair of mount plates vertically disposed at both ends of the ice making plates, respectively, supporting opposite bent ends of the cooling zigzag pipe, a sprinkling device disposed to extend between the pair of mount plates so as to cover upper ends of the ice making plates, and a pair of extension fins formed along opposite outer side surfaces of the sprinkler, respectively, and sandwiched between the pair of mount plates.

With the above construction, the extension fins formed along opposite outer side surfaces of the splinkling device are sandwiched between the pair of mount plates, so that the sprinkler is properly positioned and firmly fixed.

DESCRIPTION OF THE PREFERRED EMBODIMENTS

Figure 1:
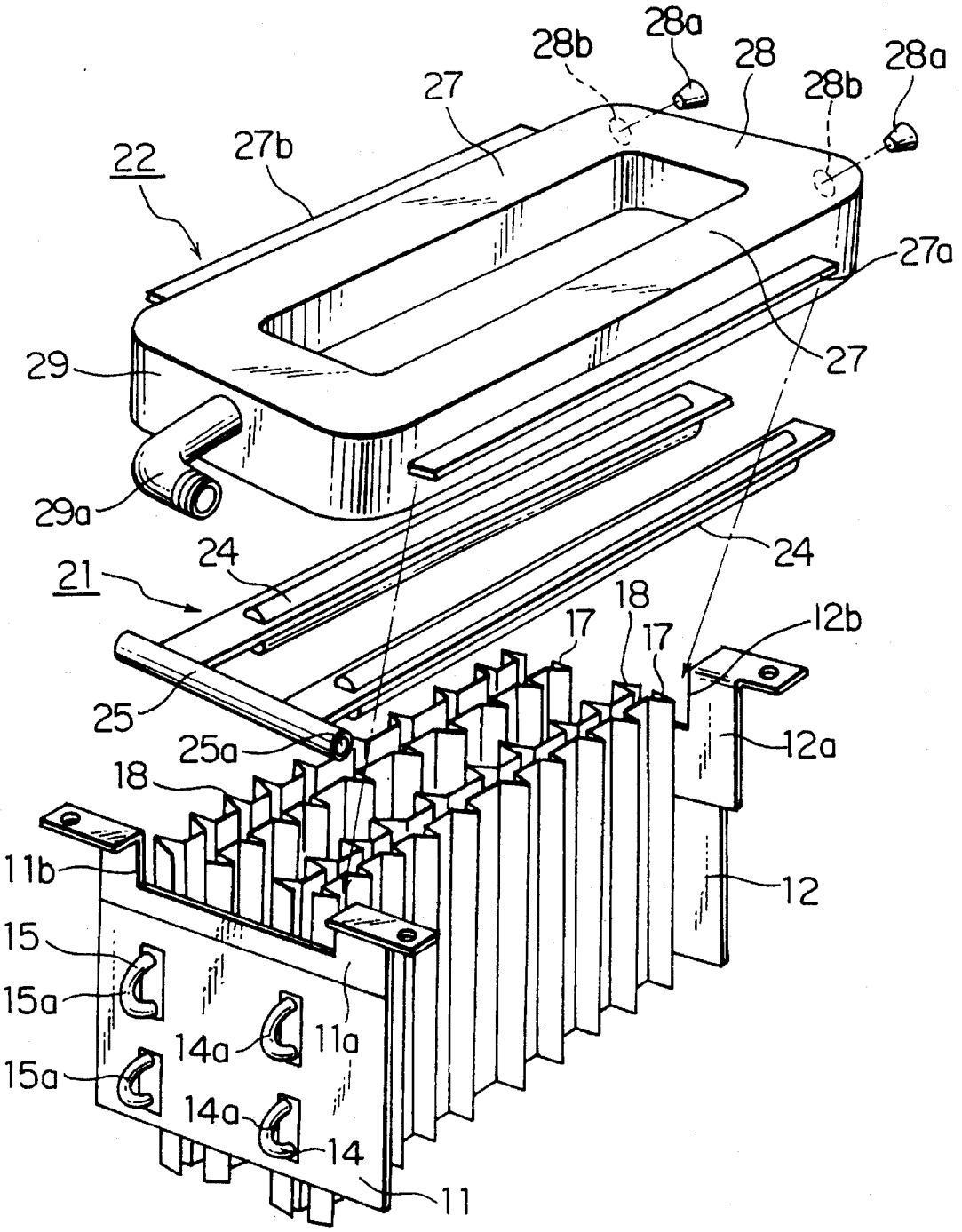
FIG. 1 is an exploded perspective view showing an entire ice making unit structure of a flow type ice making machine according to one embodiment of the present invention.

Preferred embodiments of the present invention will be hereinafter described in detail with reference to the accompanying drawings in which the same reference numerals denote the same or corresponding components.

Figure 2:
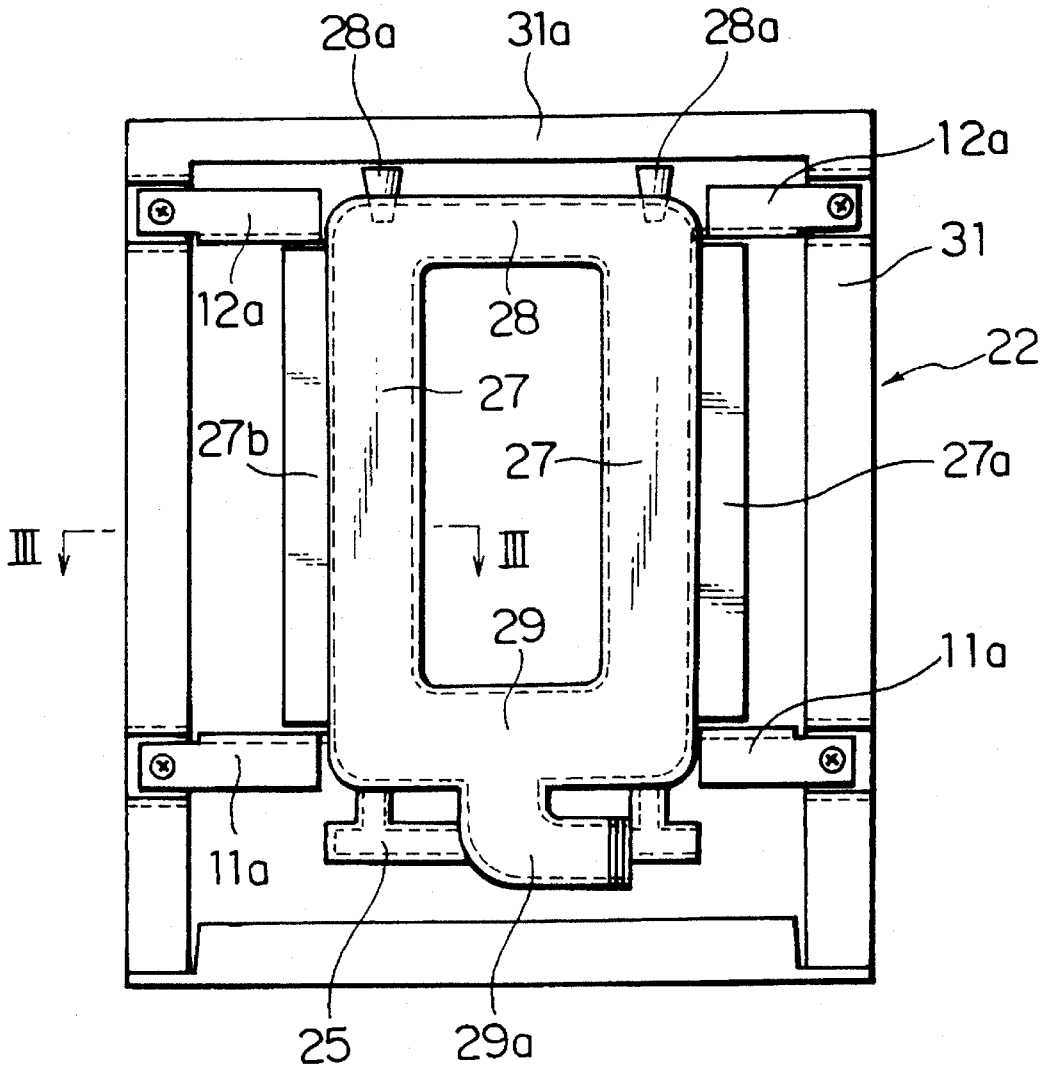
FIG. 2 is a plan view showing a principal part of the ice making unit structure of FIG. 1.

In FIGS. 1 and 2, a mount plate 11 receives and supports bent ends 14a, 15a of cooling zigzag pipes 14, 15. As guessed from the figures, the cooling zigzag pipes 14, 15 are supported at opposite bent ends (not shown) by a mount plate 12 and are extended between the pair of mount plates 11, 12 vertically disposed to face each other. Two pairs of ice making plates 17, 18 are disposed so as to respectively sandwich cooling zigzag pipes 14, 15 in contact relation therewith. The ice making plates 17, 18 have back surfaces held in contact with the cooling zigzag pipes 14, 15 and front surfaces facing outward over which ice removing water flows. The pairs of ice-making plates may be of, e.g., the structure disclosed in the above-cited Japanese Utility Model Laid-Open No. 62-176669, but their structure is not of course limited to the disclosed one.

An ice removing water sprinkler 21 and an ice making water sprinkler 22 are mounted above the ice making plates 17, 18 in such a manner as cover them. The ice removing water sprinkler 21 is fixed by being pressed by the ice making water sprinkler 22 as described later, whereas the ice making water sprinkler 22 is fixed to mount brackets 11a, 12a formed or disposed respectively above the mount plates 11, 12. The mount brackets 11a, 12a have respective cut-out portions 11b, 12b formed therein to be open upward, and hence have the substantially U-shaped form. The sprinklers 21 and 22 are both inserted in the cut-out portions. The ice removing water sprinkler 21 has two ice removing pipes 24 corresponding to the number of pairs of ice making plates 17, 18, the ice removing pipes 24 being integrally coupled to each other by a connecting pipe 25 which has a water supply port 25a.

The ice making water sprinkler 22 comprises two sprinkling pipes 27 being rectangular in section, and two connecting pipes 28, 29 coupling ends of the sprinkling pipes 27 on each side and being rectangular in section. As shown, the ice making water sprinkler 22 is of a rectangular frame-like structure or an O-shaped structure as a whole so that water is evenly sprinkled even if a distribution of water pressure is not even. An L-shaped joint elbow 29*a* is projected from an outer side surface of one connecting pipe 29 in its intermediate portion, and two cleaning plugs 28*a*, schematically shown, each having the form of a truncated cone are fitted to an outer side surface of the other connecting pipe 28. The cleaning plugs 28*a* serve to close cleaning holes 28*b* used for cleaning the interior of the sprinkler 22. In the illustrated embodiment, extension fins or ears 27*a*, 27*b* (which may have the same shape) are formed in a unitary structure with the respective sprinkling pipes 27 along their outer side surfaces.

Figure 3:
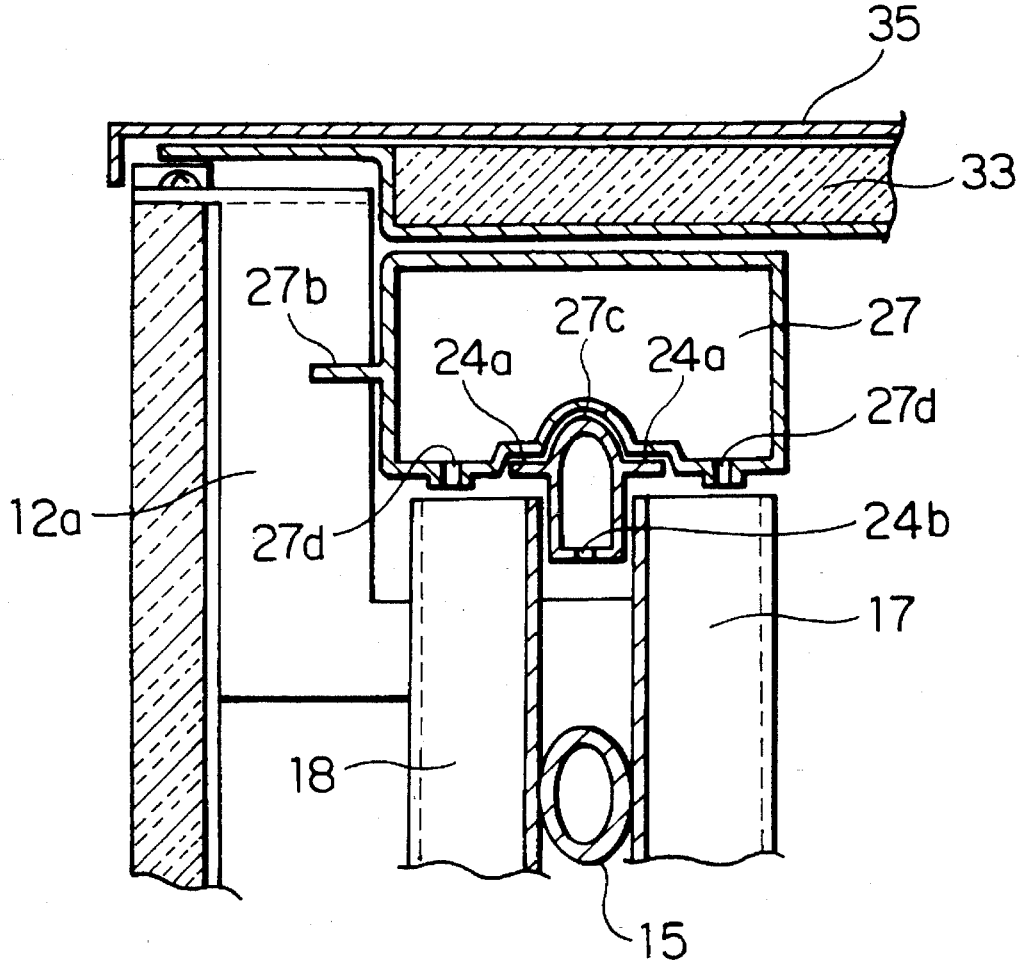
FIG. 3 is a partial sectional view taken along line III—III in FIG. 2.

Referring now to FIG. 3 which is a partial sectional view taken along line III—III in FIG. 2 and FIG. 4 which is an exploded perspective view showing an assembled state of the ice-removing water sprinkler 21 and the ice making water sprinkler 22 as viewed from below, each of the ice removing pipes 24 has its lower half portion inserted between the pair of ice making plates 17, 18, and is supported on the ice making plates 17, 18 at one pair of retainer fins 24*a* which are projected laterally in the horizontal direction from the boundary between its upper and lower half portions. In a bottom wall of the lower half portion, a number of sprinkling holes 24*b* are bored with certain intervals in the longitudinal direction so that, as well known, supplied water flows between the back surfaces of the ice making plates 17, 18 in an ice removing cycle. This flow of water cooperates with a hot gas flowing through the cooling zigzag pipe 15 to remove ice produced on the ice making surfaces of the ice making plates.

Figure 4:
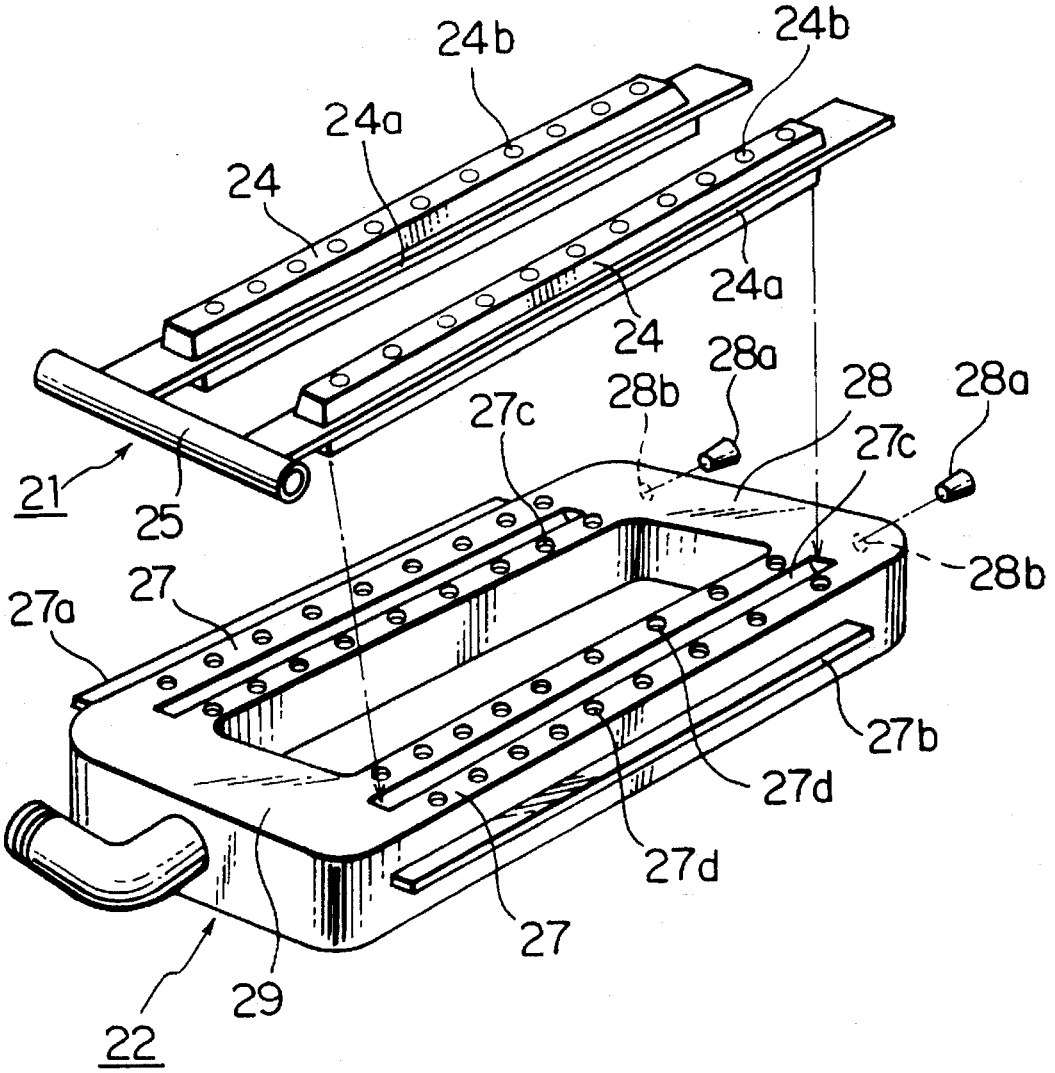
FIG. 4 is an exploded perspective view showing an ice making water sprinkler and an ice removing water sprinkler in the ice making unit structure of FIG. 1.

As shown in FIGS. 2, 3 and 4, the ice making water sprinkler 22 is arranged such that each of its sprinkling pipes 27 lies over the corresponding ice removing pipe 24 of the ice removing water sprinkler 21. As best shown in FIG. 2, the sprinkling pipes 27 are prevented from deviating from their proper positions in the longitudinal direction by the mount brackets 11*a*, 12*a* located close to opposite ends of the ears 27*a*, 27*b*. In other words, the sprinkler 22 is properly positioned in the longitudinal direction and held in place by the mount brackets 11*a*, 12*a* of the mount plates 11, 12. Furthermore, as seen from FIGS. 3 and 4, a groove 27*c* having a saddle-shaped section is formed in a bottom wall of each of the sprinkling pipes 27 to receive the head or upper half portion of the ice removing pipe 24 which is fitted in a space between the ice making plates 17, 18. Accordingly, the ice removing pipes 24 and the sprinkling pipes 27, hence the ice removing water sprinkler 21 and the ice making water sprinkler 22 are prevented from displacing relative to each other in the transverse direction (i.e., in directions horizontally extending to the left and right in FIG. 3). On both the sides of the groove 27*c*, a number of sprinkling holes 27*d* are bored in the bottom wall of each of the sprinkling pipe 27 with certain intervals in the longitudinal direction. During ice making operation, ice making water is supplied and scattered from the sprinkling holes 27*d* to flow over the front surfaces of the ice making plates 17, 18, i.e., the ice making surfaces.

Further, referring to FIGS. 2 and 3, the mount plates 11, 12 supporting the bent ends of the cooling zigzag pipes 14, 15 are fixed through the mount brackets 11*a*, 12*a* to a body frame 31 by means such as screws illustrated (see particularly FIG. 2), thereby providing the greater structural strength. Then, the mount brackets 11*a*, 12*a* are formed and arranged such that they hold the ears 27*a*, 27*b* of the sprinkler 22 therebetween in the longitudinal direction and are terminated in positions close to respective outer side surfaces of the sprinkling pipes 27. In addition, one internal structural member 31*a* of the body frame 31 has its inner side surface located close to outer end faces of the cleaning plugs 28*a*. As a result, the position of the sprinkler 22 is restricted in both the longitudinal and transverse directions in the assembled state. Also, since the cleaning plugs 28*a* are located in contact with or close to the internal structural member 31*a*, the sprinkler 22 cannot be assembled in place unless the plugs are fully inserted, and the plugs will not be slipped off even if they are loosened during the use for a long term.

Figure 11:
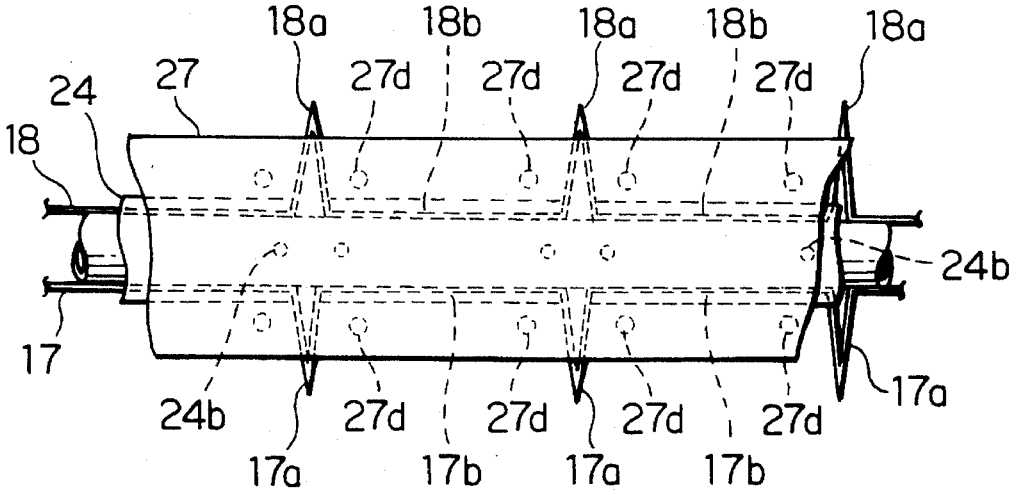
Figure 12:
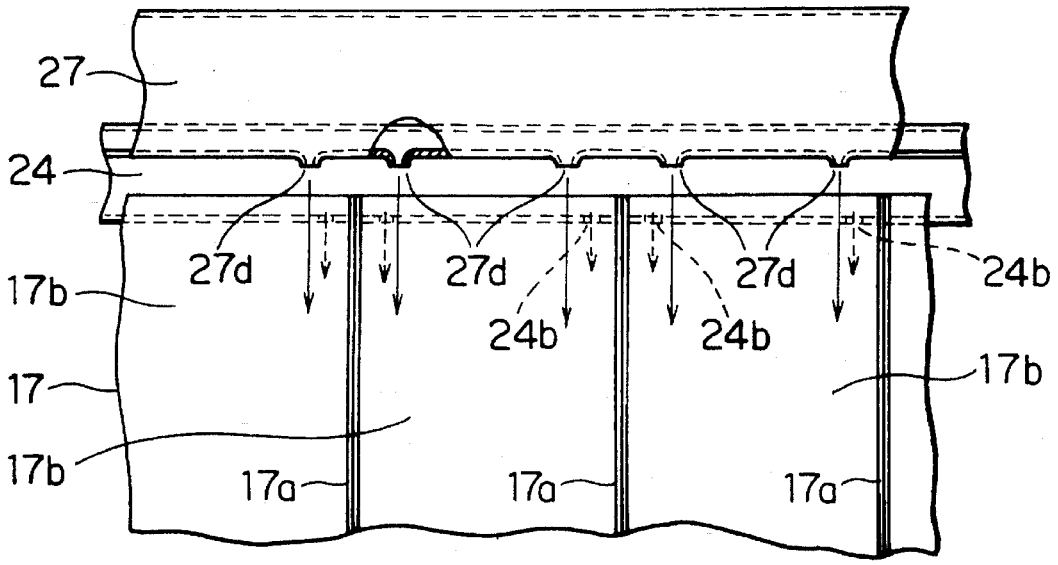

According to the above-described ice making unit structure thus constructed, as shown in FIGS. 11 and 12, the splinkling holes 27*d* formed in the bottom wall of the sprinkling pipes 27 are surely positioned in predetermined positions with respect to ice making surfaces 17*b*, 18*b* defined between adjacent twos of multiple partitions 17*a*, 18*a* of the ice making plates 17, 18 without suffering deviation in their positions. Therefore, the flows of the ice making water over the ice making surfaces 17*b*, 18*b* of the ice making plates 17, 18 are stabilized to produce ice of high quality. Since the ice removing pipes 24 are properly positioned with respect to the splinkling pipes 27, the splinkling holes 24*b* formed in the bottom wall of the ice removing pipes 24 are also surely positioned in predetermined positions with respect to rear surfaces of the ice making plates 17, 18 without suffering deviation in their positions. Accordingly, the flows of the ice removing water are stabilized to ensure the excellent ice removing ability.

Above the sprinklers 21, 22 which are restricted in their displacements in both the longitudinal and transverse directions, i.e., displacements in a horizontal plane, by the mount brackets 11*a*, 12*a* and the body frame 31 as described above, a heat insulating plate 33 is disposed and firmly fixed by a top plate 35 which is placed over the heat insulating plate 35.

In the ice making unit structure thus constructed, the ice making operation and the ice removing operation are carried out in a similar manner as in a conventional flow type ice machine such that ice making water is supplied to the ice making water sprinkler 22 and is scattered to flow over the ice making surfaces of the ice making plates 17, 18, whereas ice removing water is scattered to each space between the ice making plates 17, 18.

It will be apparent to those skilled in the art that while the above embodiment has been described in connection with the case of having the two pairs of ice making plates 17, 18, ice machines including the pairs, e.g., three or four pairs, of ice making plates in number larger than two can also be constructed in accordance with the same concept, although the entire machine size is enlarged correspondingly, by increasing the numbers of the ice removing water pipes 2 of the sprinkler 21 and sprinkling pipes 27 of the sprinkler 22 to three, four and so on.

Figure 5:
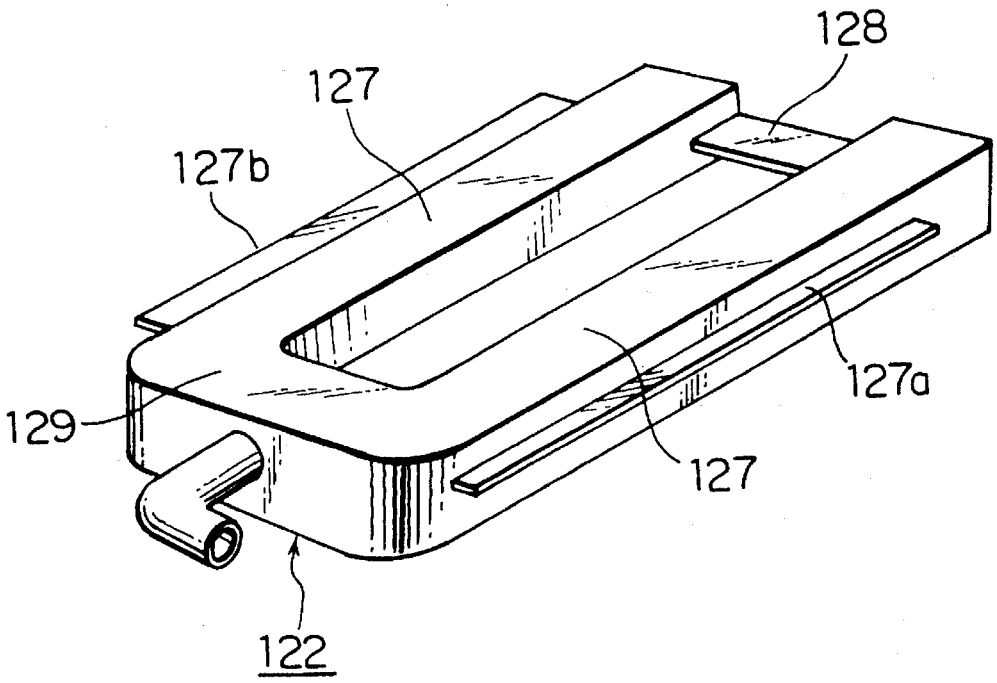
FIG. 5 is a perspective view showing a principal part of another embodiment.
Figure 6:
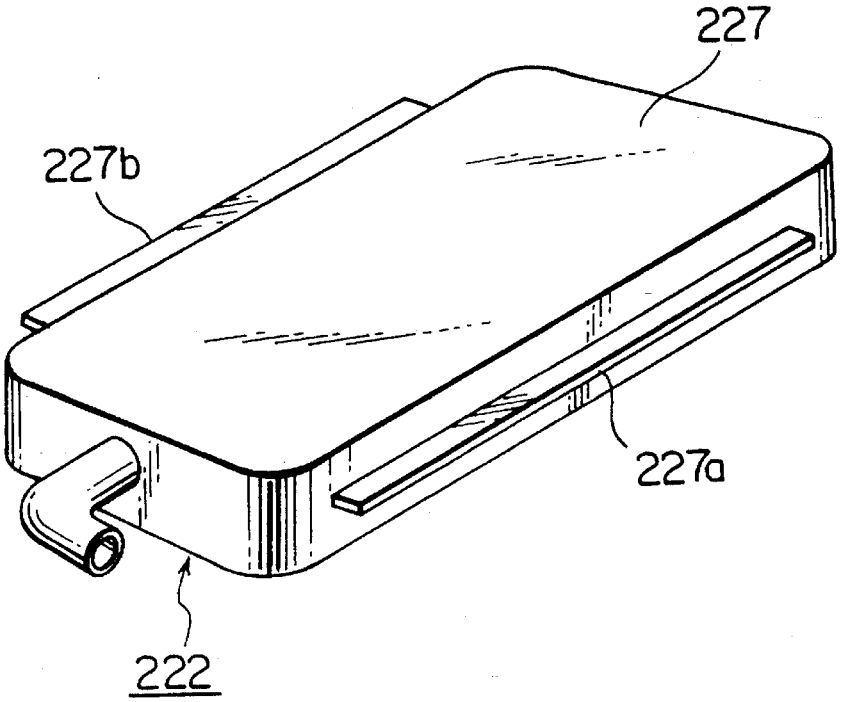
FIG. 6 is a perspective view showing a principal part of still another embodiment.
Figure 7:
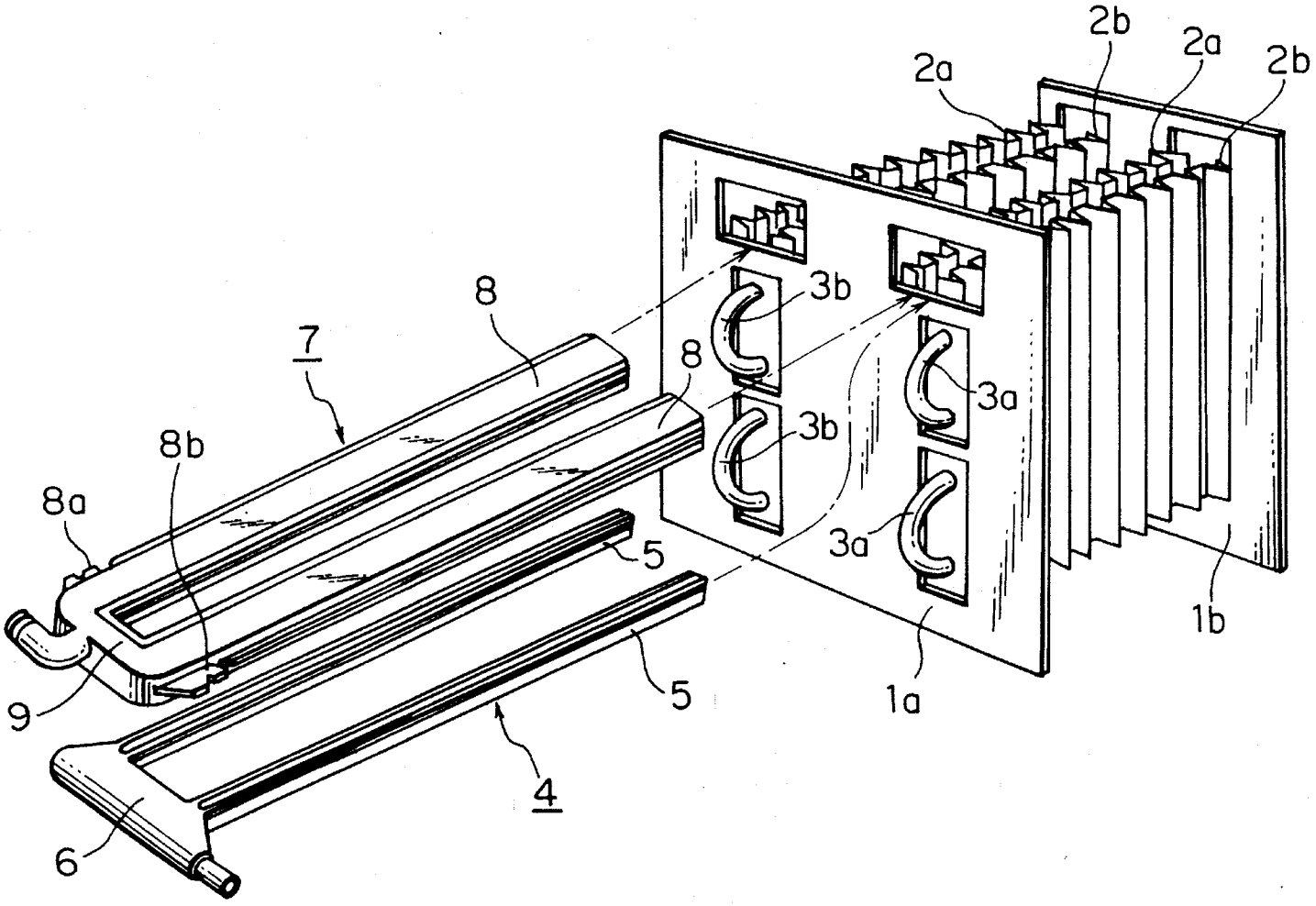
FIG. 7 is an exploded perspective view showing an ice making unit structure of a conventional flow type ice machine.
Figure 8:
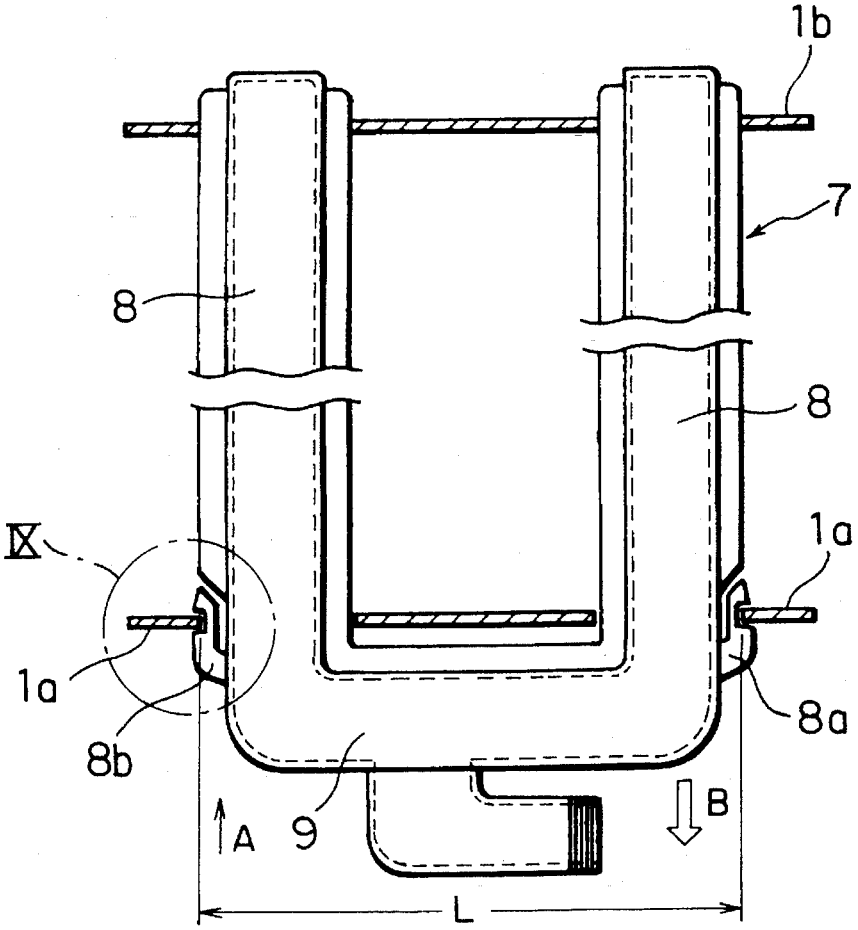
FIG. 8 is a plan view showing a part of the ice making unit structure of FIG. 7.
Figure 9:
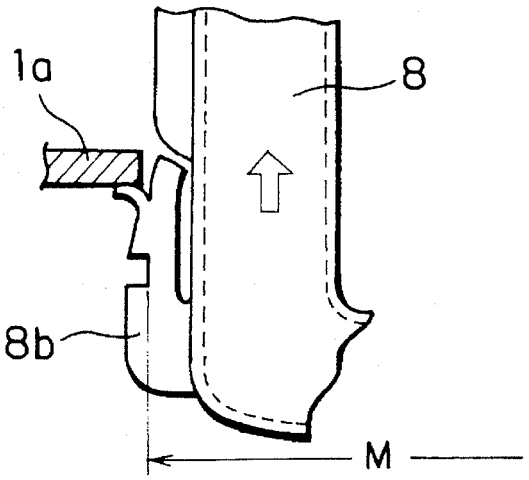
FIG. 9 is a partial enlarged view for explaining a drawback of the ice making unit structure of FIG. 7 which is caused in an area encircled by a chain line IX in FIG. 8.
Figure 10:
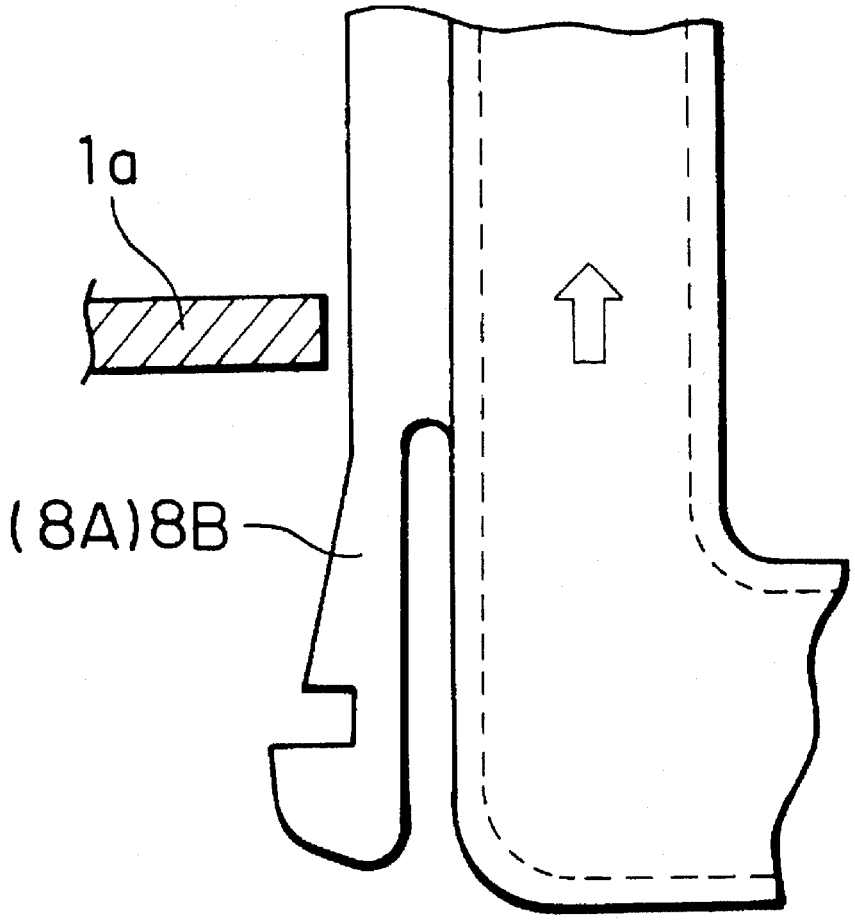
FIG. 10 is a partial enlarged view of a reference modification for solving the drawback of a conventional stopper shown in FIG. 9, and FIGS. 11 and 12 are a partial plan view and a partial side view, respectively, showing the relation of position between the ice making water sprinkler and the ice making plate in the ice making unit structure of FIG. 1.

The ice making water sprinkler may be modified, as shown in FIG. 5, such that two sprinkling pipes 127 and a coupling pipe 129 are integrally formed into the U-shaped planar form, and distal ends of the sprinkling pipes 127 are coupled to each other by a connecting plate 128 for reinforcement. Alternatively, it may be modified into a rectangular box-like sprinkler 222 as shown in FIG. 6. In any case, as with the above-described embodiment, ears 127*a* and 127*b* or 227*a* and 227*b* are formed on outer side surfaces of the sprinkling pipes 127 or a sprinkling box 227 so as to properly position and fix the sprinkler 122 or 222.

According to the present invention, as described above, a sprinkler is disposed between a pair of mount brackets provided on mount plates, and the sprinkler is positioned in place and restricted in its movement by the mount brackets which are located close to opposite longitudinal ends of ears formed on outer side surfaces of the sprinkler. Therefore, allowable tolerances of the assembly members are moderated, resulting in a reduced production cost. An ice making unit can be easily assembled just by placing the sprinkler on the mount plates. The position of the sprinkler with respect to ice making plates is stabilized to reduce variations in amount of water scattered.

Since the ice removing water sprinkler is held between the upper end of the ice making plate and the lower surface of the ice making water sprinkler and has a lower-half portion inserted between the pair of ice making plates, the ice removing water sprinkler is also positively fixed. This makes it possible to prevent the ice removing water sprinkler from slipping off and its sprinkling holes for the ice removing water from deviating in their positions.

By fixedly holding the upper portion of the ice making water sprinkler by the top plate of the ice machine, the ice making water sprinkler can be easily positioned vertically and restricted in vertical movement. Further, by fitting projections on the upper surface of the ice removing water sprinkler to recesses formed in the lower surface of the ice removing water sprinkler, the ice making water sprinkler and the ice removing water sprinkler are fixed in place without suffering deviation in their relative positions. Thus, the ice-making water sprinkler and the ice removing water sprinkler can be more easily positioned.

Additionally, since cleaning plugs fitted to one end face of the springer are located in contact with or close to one internal structural member, it is possible to prevent not only an assembly failure, but also slip-off of the cleaning plugs even during the use for a long term.

What is claimed is:

1. An ice making unit structure of a flow type ice making machine comprising:

a cooling zigzag pipe through which a coolant flows;

at least one pair of ice making plates vertically disposed so as to sandwich said cooling zigzag pipe therebetween;

a pair of mount plates vertically disposed at both ends of said ice making plates, respectively, supporting opposite bent ends of said cooling zigzag pipe;

a sprinkling device disposed to extend between said pair of mount plates so as to cover upper ends of said ice making plates; and a pair of extension fins formed along opposite outer side surfaces of said sprinkling device, respectively, and sandwiched between said pair of mount plates.

2. An ice making unit structure according to claim 1 wherein said sprinkling device comprises an ice making water sprinkler and an ice removing water sprinkler attached to the underside of said ice making water sprinkler, said pair extension fins being formed on outer side surfaces of said ice making water sprinkler.

3. An ice making unit structure according to claim 2 wherein a convex lower portion of said ice removing water sprinkler is fitted between said pair of ice making plates.

4. An ice making unit structure according to claim 2 wherein a convex upper portion of said ice removing water sprinkler is fitted to a groove formed in a bottom wall in said ice making water sprinkler.

5. An ice making unit structure according to claim 1 further comprising:

a body frame for supporting said pair of mount plates;

an internal structural member of said body frame; and a cleaning plug fitted to a cleaning hole formed in one end face of said sprinkler and located in contact with or close to said internal structural member.

6. An ice making unit structure according to claim 5 further comprising:

a heat insulating plate disposed above said sprinkling device; and a top plate covering said heat insulating plate and engaging said body frame.

7. An ice making unit structure according to claim 2 wherein each of said mount plates has a cut-out portion being open upward, said sprinkling device being inserted into said cut-out portions of said mount plates.

8. An ice making unit structure according to claim 2 wherein said ice making water sprinkler has an annular pipe structure in the rectangular or O-shaped form.

9. An ice making unit structure according to claim 2 wherein said ice making water sprinkler has a pipe structure in the U-shaped form.

10. An ice making unit structure according to claim 2 wherein said ice making water sprinkler has a rectangular flat-box structure.

* * * * *